United States Patent [19]

Gustafson

[11] Patent Number: 4,872,427

[45] Date of Patent: Oct. 10, 1989

[54] POSITION CONTROLLER FOR A ROTATABLE SHAFT

[75] Inventor: Richard J. Gustafson, Columbus, Ind.

[73] Assignee: Cummins Engine Company, Inc., Columbus, Ind.

[21] Appl. No.: 277,644

[22] Filed: Nov. 29, 1988

[51] Int. Cl.[4] ..... F01L 1/34; F02M 37/04

[52] U.S. Cl. ..... 123/90.16; 123/508

[58] Field of Search ..... 123/90.15, 90.16, 90.43, 123/500, 501, 502, 507, 508; 74/578; 192/45.1; 188/82.1, 82.3

[56] References Cited

U.S. PATENT DOCUMENTS

| | | | |
|---|---|---|---|
| 1,980,686 | 11/1934 | Kinsman | 74/505 |
| 2,772,667 | 12/1956 | Nallinger | 123/90.43 |
| 2,880,711 | 4/1959 | Roan | 123/90.16 |
| 3,861,506 | 1/1975 | Dossier | 192/43 |
| 3,897,760 | 8/1975 | Hisserich | 123/90.16 |
| 3,945,221 | 3/1976 | Miokovic | 123/90.17 |
| 4,007,815 | 2/1977 | Acre | 188/265 |
| 4,057,220 | 11/1977 | Kudlacek | 254/186 HC |
| 4,206,734 | 6/1980 | Perr et al. | 123/502 |
| 4,506,635 | 3/1985 | Van Rinsum | 123/90.43 |
| 4,586,329 | 5/1986 | Carlin | 188/82.3 |

FOREIGN PATENT DOCUMENTS

| | | | |
|---|---|---|---|
| 39964 | 3/1984 | Japan | 123/501 |

*Primary Examiner*—Charles J. Myhre
*Assistant Examiner*—Weilun Lo
*Attorney, Agent, or Firm*—Sixbey, Friedman, Leedom and Ferguson

[57] ABSTRACT

The present invention is directed to a system for actuating a cam follower shaft to permit variable timing of the valving events or the unit injectors of an internal combustion engine. A rotatable cam follower shaft is subjected to continuous, alternating, oscillating torques. A clutch is disposed adjacent the shaft and is translatable to move from a disengaged position to an engaged position in which the clutch engages the shaft either directly or through roller bearings and separate inclined surfaces. When the clutch engages the shaft, it prevents rotation in a first direction while permitting rotation in a second direction until a positive stop is reached. When the clutch is disengaged from the shaft, the overall torques acting on the shaft rotate the shaft in the first direction until the shaft reaches another positive stop. The clutch is activated by a compression spring which is resisted by fluid pressures.

47 Claims, 4 Drawing Sheets

POSITION CONTROLLER FOR A ROTATABLE SHAFT

BACKGROUND OF THE INVENTION

1. Field of The Invention

The present invention relates to controllers for rotatable shafts used in internal combustion engines of motor vehicles. More particularly, the present invention relates to a one-way clutch which allows rotation of a shaft in either direction.

2. Description of The Related Art

Internal combustion engines use a cam shaft which is arranged to controllably open and close the intake and exhaust valves and operate the fuel injector of the engine. The timings for the valving events frequently are fixed for the entire operating conditions of the engine. The opening and closing of the intake and exhaust valves is timed to provide an optimum performance efficiency of the engine during normal cruising speeds for the motor vehicle. However, when the motor vehicle is driven at low speeds, engine performance suffers. Designs of cam shafts that control the intake and exhaust valves at fixed intervals compromise the mutually conflicting requirements of light load and heavy load operating conditions for the engine. Either the requirements of the light load or those of the heavy load operations of the engine are sacrificed.

To resolve these problems, variable valve timing cam shafts have been developed. Variable valve timing cam shafts use a drive mechanism that advances or retards the valving events to improve the overall efficiency and performance of the engine. The opening and closing timings of the intake and exhaust valves can be varied in relation to preselected operating conditions of the engine, such as the output speed of the engine or the vacuum developed in the intake manifold of the engine. Variable valve timing cam shafts improve the engine performance, efficiency, and fuel economy, and also reduce toxic exhaust emissions from the engine.

Numerous patents disclose variable valve timing devices. In Miokovic, U.S. Pat. No. 3,945,221 a coupling device includes a sliding member slidably axially mounted on a first driving shaft. The sliding member slides axially to vary the angular timing of a second separately driven shaft in relation to the first driving shaft. This varies the timing of the engine. In Hisserich, U.S. Pat. No. 3,897,760 varying the valve timing of the intake and exhaust valves is performed by varying the distance between the cam shaft axis and valve lifters which control the portion of the cam shaft revolution during which the cam lobes contact the lifters.

Many patents also disclose mechanical-type clutch systems. In Dossier U.S. Pat. No. 3,861,506, friction-free wheels are provided with a locking reversal device. This system allows rotation in both clockwise and counterclockwise directions. In Kudlacek, U.S. Pat. No. 4,057,220 a ratchet type operator using a spring-loaded arm permits unidirectional rotation of a winch shaft. Other patents such as Carlin, U.S. Pat. No. 4,586,329; Acre, U.S. Pat. No. 4,007,815; and Kinsman, U.S. Pat. No. 1,980,686 are representative of a body of art which discloses releasable locks and antirotation devices for shafts which prevent the shafts either from rotating or from translating. All of these patents disclose mechanisms that either hold a shaft stationary or allow it to move. They do not control the direction of rotation of a shaft. Nor do any devices disclose a system wherein the shaft positions itself without external devices.

SUMMARY OF THE INVENTION

It is an object of the present invention to provide a one-way clutch which allows and controls shaft rotation in either a clockwise or counterclockwise direction.

It is another object of the present invention to provide a one-way clutch which allows shaft rotation in either direction while the shaft is subject to continuous, alternating, opposing, oscillating torques with a non-zero mean torque.

It is another object of the present invention to accomplish the above objects with a rotatable shaft that positions itself in an advanced or retarded position without external aids.

The shaft position controller according to the present invention may be used in any engine in order to advance or retard any or all of the valving events. The shaft position controller can be used to advance or retard all of the valves driven by the cam shaft and also to vary the timing of the unit injectors.

The controller for controlling the rotation and the angular position of a rotatable shaft according to the present invention permits the shaft to be rotatably disposed within a housing. The shaft is subjected to continuous, alternating, oscillating torques with a non-zero mean torque and can be a cam follower shaft that is subjected to torques by eccentric cam follower pivots. The shaft includes a rotation limiting bar.

A one-way clutch is disposed within a clutch receiving opening in the housing which is formed adjacent to the shaft opening in the housing. The shaft is a cam follower shaft and facilitates the operation of the intake and exhaust valves and the injector of an internal combustion engine. In one embodiment, the clutch has an inclined locking surface which selectively engages a side surface of the shaft. The clutch also includes an inner surface and an outer surface, and the clutch is translatable within the clutch receiving opening between a disengaged position and an engaged position. In the disengaged position, the clutch does not restrict the rotation of the shaft. In the engaged position, the inclined locking surface of the clutch frictionally engages the shaft to provide a wedging among the housing, the clutch, and the shaft to thereby prevent rotation of the shaft.

In another embodiment, a plurality of inclined surfaces are disposed end to end to form an annular ring which is mounted on the housing. A plurality of bearings are disposed between the inclined surfaces and the shaft, at least one bearing being adjacent each inclined surface. Two annular cages connected by cross members retain the bearings around the shaft. One cross member is disposed in a slot in the clutch (there is no inclined surface on the clutch) to connect the clutch to the bearings. Leaf springs bias the bearings between adjacent cross members. In the engaged position of this embodiment, the bearings are frictionally wedged between the inclined surfaces and the shaft to prevent rotation of the shaft.

A compression spring is disposed in the clutch receiving opening between an end wall of the clutch receiving opening and the inner surface of the clutch. The compression spring biases the clutch toward the engaged position. A fluid passageway is disposed within the housing and communicates with the clutch receiving opening adjacent the outer surface of the clutch. Fluid flowing through the fluid passageway contacts and exerts a pressure on the outer surface of the clutch to bias the clutch toward the disengaged position and to resist the biasing force of the compression spring.

Sealing means such as an O-ring disposed around the clutch adjacent its outer surface provides a fluid seal between the clutch and the clutch receiving opening. In addition to sealing, the O-ring also prevents translational oscillations of the clutch within the clutch receiving opening when the fluid pressure approximates the pressure of the compression spring. This prevents the shaft from fluttering due to the oscillating torques when the clutch engages the shaft.

In one preferred embodiment of the present invention, the controller allows the shaft to assume one of two positions, one in which the valve timing or injection is advanced, and one in which the valve timing is retarded. However, in other embodiments, the position of the shaft can be controlled so that it is infinitely variable. In the preferred embodiment described below, the shaft may reside in one of two positions; two pivot stops are located so that the rotation limiting bar of the shaft engages one of the two stops. When the rotation limiting bar of the shaft engages a first stop, the valve timing is advanced and when the rotation limiting bar engages a second stop, the valve timing is retarded. Generally, the angular rotation of the shaft is limited by the pivot stops to a range of 180 degrees. In the preferred embodiment, the range of rotation for the shaft is 90 degrees.

An important feature of this invention is that the shaft assumes its position without external devices such as air cylinders. The oscillating torques acting on the shaft permit this feature. This renders the device of the present invention more compact, thereby saving much needed space in the engine compartment. The invention is also less expensive.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
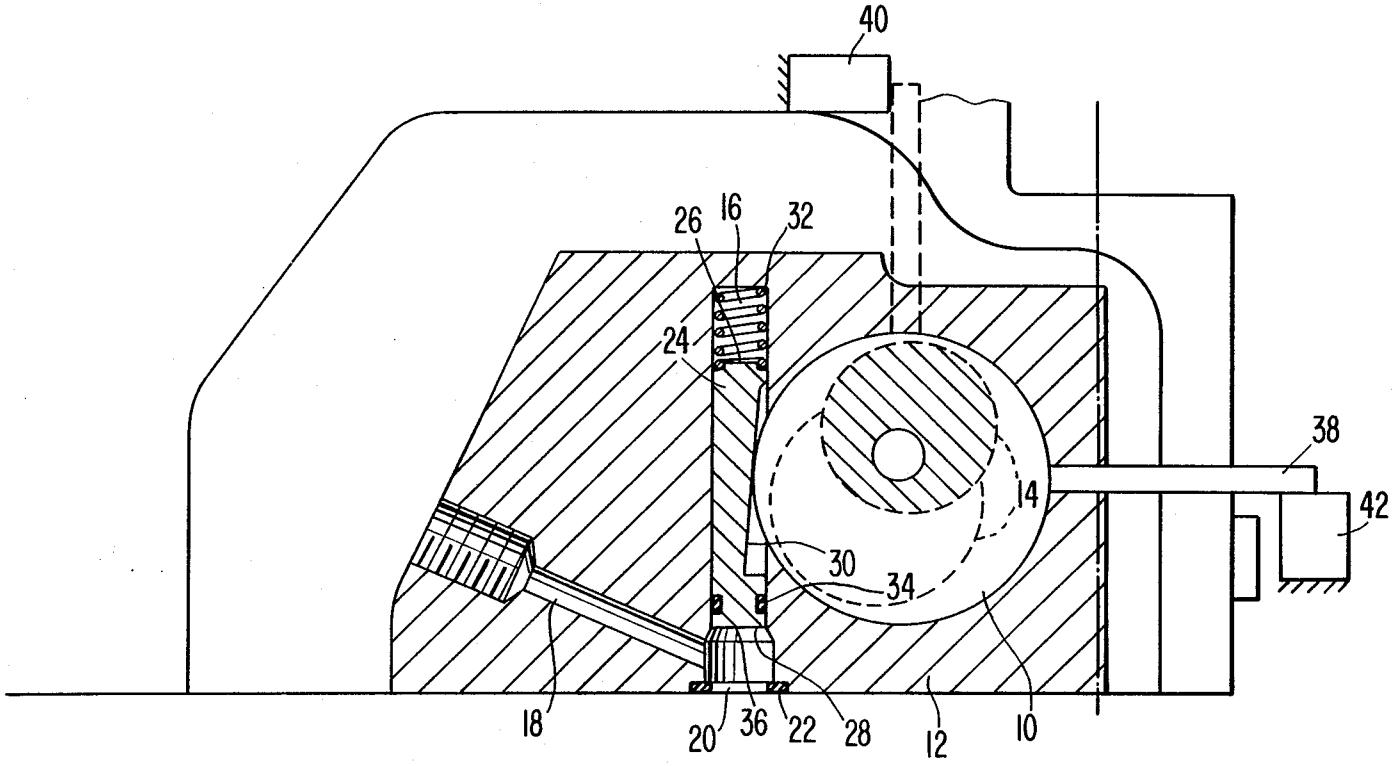
FIG. 1 is a cross-sectional view of a cam follower shaft support with the shaft rotation controller according to the present invention with the clutch activated and the shaft located in a retarded timing position.
Figure 2:
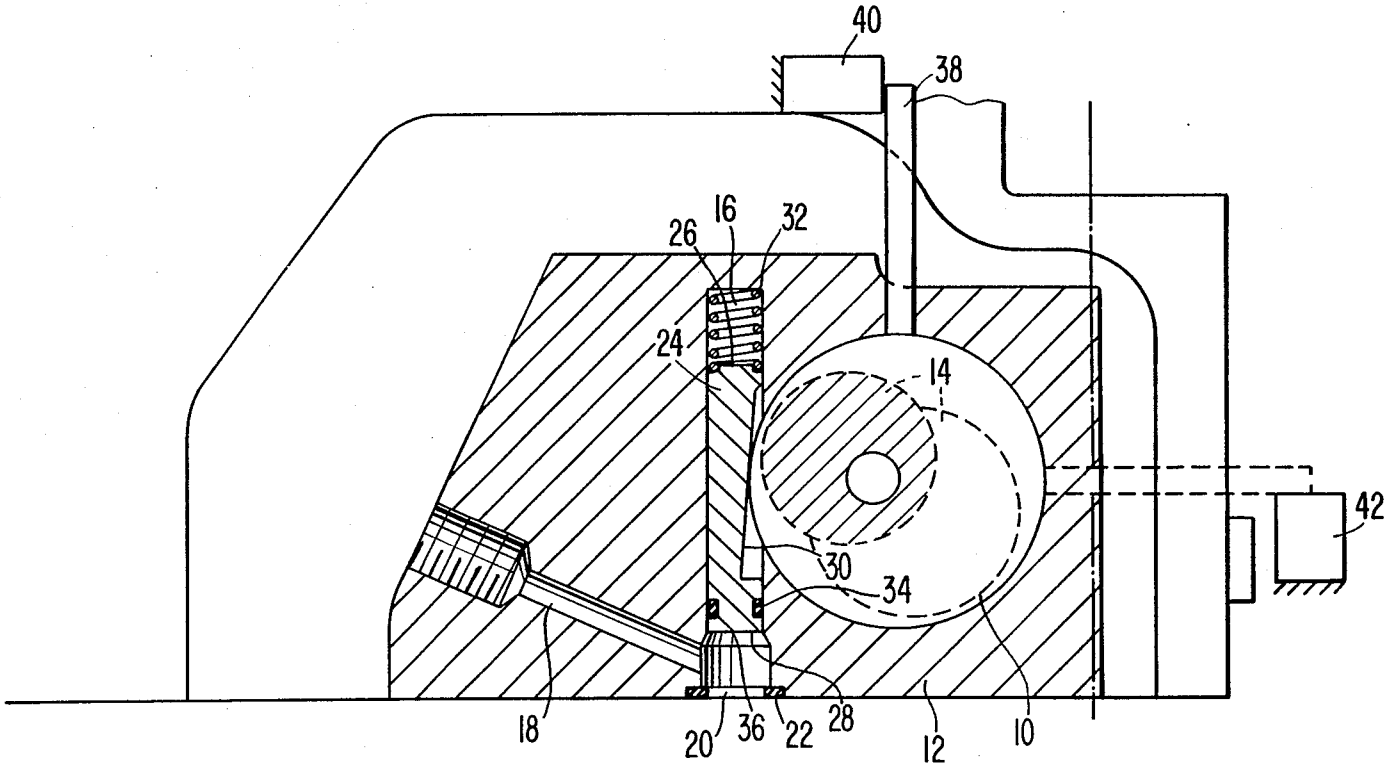
FIG. 2 is a sectional view of the shaft rotation controller of FIG. 1 with the clutch deactivated and the shaft disposed in the advanced timing position.

FIGS. 1 and 2 show a first embodiment of one-way clutch which controls the rotation of a cam follower shaft, in accordance with the present invention, wherein a cam follower shaft 10 is rotatably mounted within a housing 12. An eccentric cam follower pivot 14 is disposed coaxially with and behind shaft 10. Eccentric cam follower pivot 14 may be mounted on shaft 10 by slipping it over and around shaft 10, or eccentric cam follower pivot 14 may be formed as part of shaft 10 as by grinding. A clutch receiving opening 16 is formed as a blind bore within housing 12 adjacent shaft 10. A fluid passageway 18 communicates with one end of clutch receiving opening 16, near its open end. A clutch cover 20 closes receiving opening 16 at its open end. An O-ring 22 is disposed around the open end of clutch receiving opening 16 to provide a fluid seal between clutch receiving opening 16 and the exterior of housing 12, between and around clutch cover 20. The top of clutch receiving opening 16 is vented to the engine crankcase (not shown).

A one-way piston type clutch 24 is disposed within clutch receiving opening 16. Clutch 24 includes inner end surface 26, outer end surface 28, and inclined locking surface 30. A compression spring 32 is disposed at the inner end of clutch receiving opening 16 against inner surface 26 of clutch 24. Compression spring 32 exerts a downward force on clutch 24 and biases clutch 24 toward an engaged position wherein clutch 24 engages shaft 10. Fluid is selectively allowed to flow within fluid passageway 18 to exert a fluid pressure on outer end surface 28 of clutch 24 to resist the force of compression spring 32. When the force of compression spring 32 is greater than the fluid pressure, clutch 24 is moved into a position in which it engages shaft 10. When the fluid pressure is greater than the pressure caused by compression spring 32, the fluid pressure moves clutch 24 upwardly so that it disengages from shaft 10.

An O-ring 34 is mounted in an annular groove 36 of clutch 24 at the outer end of clutch 24 to seal between clutch 24 and the outer walls of clutch receiving opening 16. In addition to providing a fluid seal, O-ring 34 also prevents translational oscillations of clutch 24 from causing shaft 10 to flutter by frictionally engaging the walls of clutch receiving opening 16. Thus, O-ring 34 provides a hysteresis which improves the stability of the system and prevents the clutch, and therefore the shaft from fluttering when the fluid pressure exerted on outer surface 28 of clutch 24 approximates the pressure caused by the force of compression spring 32 on inner surface 26 of clutch 24. The frictional force of O-ring 34 also must be overcome by either the force of compression spring 32 or the force caused by the fluid pressure to move clutch 24.

A rotation limiting bar 38 radially projects from cam follower shaft 10 and extends outwardly a distance sufficient to enable rotation limiting bar 38 to alternately engage pivot stops 40, 42. When rotation limiting bar 38 engages pivot stop 40, cam follower shaft 10 is in a mode in which the valving events are advanced. When rotation limiting bar 38 engages pivot stop 42, the valving events are retarded. Thus, pivot stop 40 is an advancing pivot stop and pivot stop 42 is a retarding pivot stop.

Figure 3:
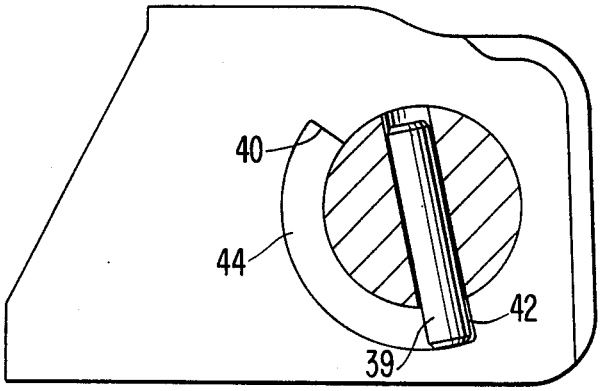
FIG. 3 shows an alternate embodiment for the rotation limiting bar and pivot stops.

In FIG. 3, rotation limiting bar 38 is a pin 39 disposed in a radial bore in shaft 10 and extends outwardly from shaft 10. Pivot stops 40, 42 are the ends of a groove 44 machined within housing 12 to receive pin 39.

The operation of the clutch is as follows. Cam follower shaft 10 is continuously subjected to alternating, opposing, oscillating torques by eccentric cam follower pivots 14 as is typical with these internal combustion engine shafts. These torques cause shaft 10 to continuously and alternatingly rotate in both the clockwise and counterclockwise directions, although the counterclockwise torques dominate the clockwise torques (there is a mean torque in the counterclockwise direction).

The position of the clutch is determined by the static forces, the combined forces of compression spring 32 and the fluid pressure, acting on clutch 24. The fluid pressure operating the clutch is the fuel "rail" pressure which is controlled by a fuel pump and control system (not shown) which are part of a conventional fuel injection system. The rail pressure is controlled to control the fuel rate into the engine. As the fuel pump and its control system varies the rail pressure in accordance with the fuel needs of the injection system, to accommodate different phases of engine operation such as high speed and low speed operation, the rail pressure acting on the clutch is varied to operate the position controller accordingly. Compression spring 32 forces clutch 24 outwardly so that inclined locking surface 30 of clutch 24 engages the side of cam follower shaft 10 as shown in FIG. 1. This occurs at low fluid pressures in which the force of compression spring 32 exceeds the force of the fluid pressure. The engagement of clutch 24 and shaft 10 prevents shaft 10 from rotating in a counterclockwise direction as viewed in the figures, although clockwise rotation is permitted. Thus, although the counterclockwise torques acting on shaft 10 dominate, clutch 24 does not permit shaft 10 to rotate in a counterclockwise direction. Thus, the clockwise torques cause shaft 10 to rotate clockwise until rotation limiting bar 38 engages retarding pivot stop 42. In this position, the valve timing is retarded. In this mode, retarding pivot stop 42 prevents shaft 10 from rotating further in a clockwise direction while the engagement of clutch 24 with shaft 10 prevents the shaft from rotating in a counterclockwise direction.

When the fluid pressure increases and overcomes the pressure caused by the force of compression spring 32, clutch 24 is forced upwardly, and inclined locking surface 30 disengages from shaft 10, as shown in FIG. 2. In this position, clutch 24 permits shaft 10 to rotate in either direction. However, because the counterclockwise torques dominate the clockwise torques, shaft 10 rotates counterclockwise until rotation limiting bar 38 engages advancing pivot stop 40.

Figure 5:
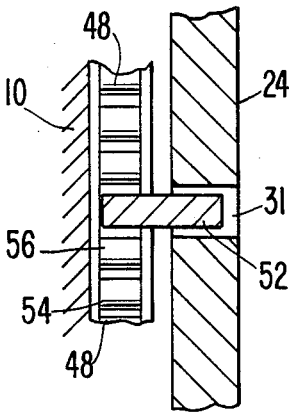
FIG. 5 is a sectional view taken along line 5—5 of FIG. 4.
Figure 4:
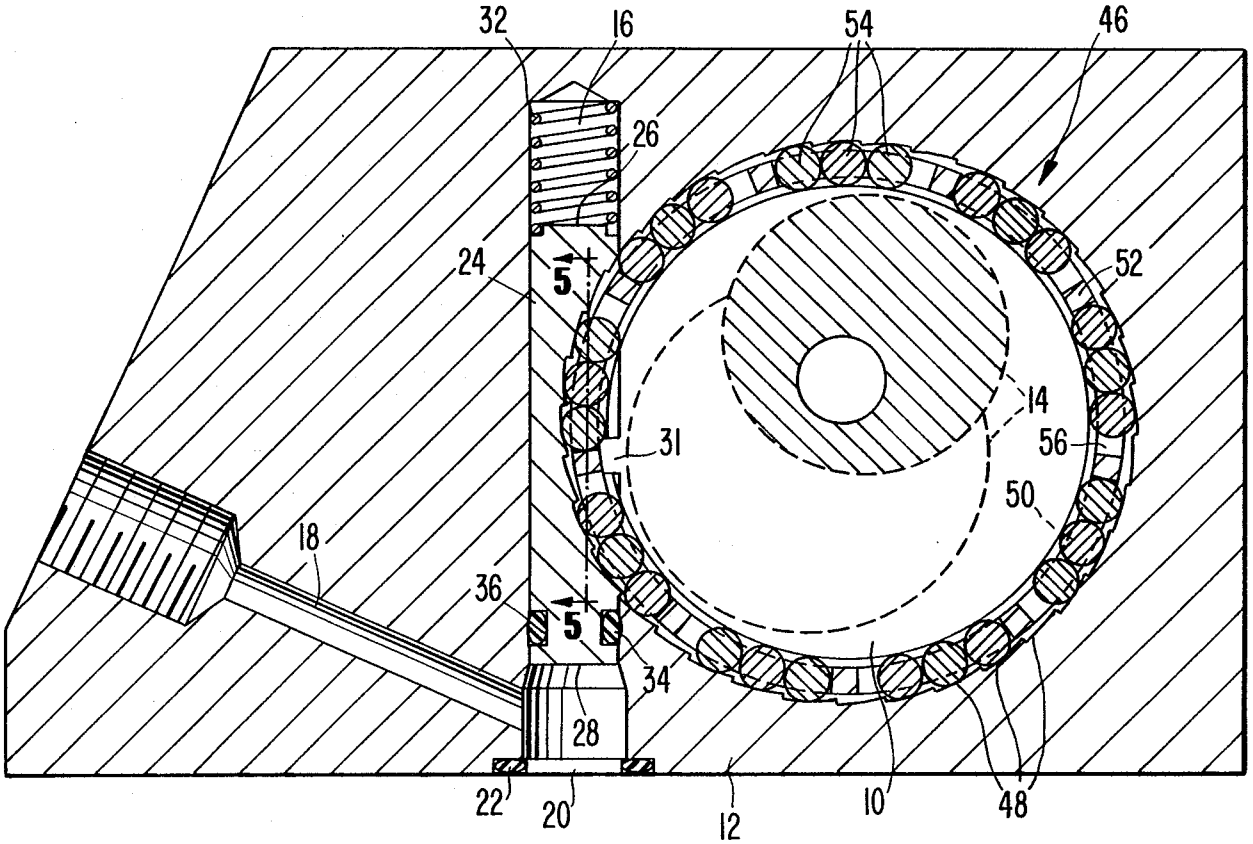
FIG. 4 is a partial sectional view of a shaft rotation controller according to another embodiment of the invention.

An alternate embodiment of the one-way clutch which can operate at higher frequencies and with lower stresses than the embodiments of FIGS. 1–3 is shown in FIGS. 4 and 5 using a variation of known roller bearing assemblies. Rotation limiting bar 38 and pivot stops 40, 42 are omitted for clarity. In this embodiment, inclined locking surface 30 of one-way piston type clutch 24 is replaced by a plurality of ramp-like inclined locking surfaces such as ramps 48 which are part of a circular roller bearing 46. Ramps 48 are mounted on housing 12 and are formed in a circular configuration. Ramps 48 are disposed on one side of clutch 24. As shown in FIG. 4, ramps 48 are mounted in front of clutch 24. Circular roller bearing 46 is mounted around cam follower shaft 10 and is connected to clutch 24 through slot 31 formed in clutch 24. Circular roller bearing 46 includes a continuous ring of ramps 48 fixed to housing 12. Two substantially parallel cages 50 are disposed between ramps 48 and cam follower shaft 10. One cage 50 is shown in dotted line in FIG. 4 in the front portion of circular roller bearing 46. The other cage 50 resides at the back portion of circular roller bearing 46 as viewed in the figure. The two cages 50 are connected to each other at discrete intervals via cross members 52. One cross member 52 extends beyond one cage 50 and is received in slot 31 to connect circular roller bearing 46 to clutch 24 as best shown in FIG. 5. As shown, three needle type bearings 54 are disposed between adjacent cross members 52 between the two cages 50, although any convenient number may be used. Cages 50 contain needle type bearings 54. Each cage 50 has an annular groove (not shown) on its inwardly facing side which receives needle type bearings 54. Needle type bearings 54 ride in the groove. Leaf spring 56 is disposed between one needle type bearing 54 and its adjacent cross member 52. Only one leaf spring 56 is disposed between any two adjacent cross members 52. Preferably leaf spring 56 biases three needle type bearings 54 between their surrounding adjacent cross members 52.

The operation of this embodiment is similar to that of earlier embodiments. When the force from the fluid pressure is greater than the force of spring 32, one-way piston type clutch 24 moves inwardly. Through the connection of cross member 52 within slot 31, cages 50 containing needle type bearings 54 rotate clockwise. This rotation moves needle type bearings away from cam follower shaft 10 to free the shaft to rotate under the influence of the oscillating torques as explained above. In this mode the shaft is freely rotatable. When the force of spring 32 overcomes the force of the fluid pressure, clutch 24 moves outwardly, thereby rotating cages 50 and needle type bearings 54 counterclockwise. This causes needle type bearings 54 to wedge between ramps 48 and cam follower shaft 10 to bind the shaft and prevent the shaft from rotating in the counterclockwise direction. In this mode, the system acts a one-way clutch and cam follower shaft 10 will ratchet itself around in the clockwise direction under the influence of the oscillating torques.

Additionally, a major advantage of both embodiments of the present invention is that the cam follower shaft does not require external devices (such as an air cylinder or a rack and pinion apparatus used in prior systems) to position the shaft in either the advanced or retarded position. Due to the effect of the oscillating torques and the clutch on the shaft, the cam follower shaft positions itself in the desired position.

Thus, the clutch system of the present invention permits cam follower shaft 10, which is subject to alternating, oscillating torques, to rotate in either one direction or another. When clutch 24 engages shaft 10, rotation is permitted in one direction only and is limited in that direction by a pivot stop. When clutch 24 disengages from shaft 10, shaft 10 is permitted to rotate in either direction, but the torques in one direction dominate and cause the shaft to rotate in that direction until limited by another pivot stop. Although the invention has been described so that the counterclockwise torques dominate and so that when clutch 24 engages shaft 10 the valve timing is retarded and when the shaft and clutch are disengaged from each other the valve timing is advanced, the shaft rotation controlling device of this invention can be configured with opposite orientations. Additionally, as shown in the figures, the outer portion of clutch receiving opening 16 has a larger diameter than the inner portion. This facilitates manufacturing the apparatus and does not effect the operation of the clutch. Also, the clutch system need not be limited to cam follower shafts.

Industrial Applicability

The position controller for a rotatable shaft finds application in a large variety of internal combustion engines. It is particularly suitable for cam follower shafts of automotive diesel engines to control valve timing due to the space savings provided by not using a separate element to position the shaft. The controller has applications with mechanical variable timing rack and pinion type actuators as well as variable valve timing activators.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. A controller for controlling the rotation and angular position of an internal combustion engine shaft wherein the shaft controls the operation of the intake and exhaust valves of the internal combustion engine to vary the timing of the valving events to optimize engine performance, and wherein the shaft is subject to alternating, opposing, oscillating torques having a non-zero mean value, said controller comprising:

engaging means for engaging the shaft and inhibiting rotation of the shaft in a first direction while permitting rotation in a second direction; and release means for releasing said engaging means from engagement with the shaft to thereby permit the shaft to rotate in the first direction.

2. A controller according to claim 1 wherein the shaft controls the operation of the fuel injectors of the internal combustion engine to vary the timing of injection.

3. A controller according to claim 1 wherein the torques acting on the shaft and said controller act together to cause the shaft to assume either a position of advanced timing or a position of retarded timing absent addition external controls.

4. A controller for controlling the rotation and angular position of an internal combustion engine shaft wherein the shaft controls the operation of the fuel injectors of the internal combustion engine to vary the timing of injection to optimize engine performance, and wherein the shaft is subject to alternating, opposing, oscillating torques having a non-zero mean value, said controller comprising:

engaging means for engaging the shaft and inhibiting rotation of the shaft in a first direction while permitting rotation in a second direction; and release means for releasing said engaging means from engagement with the shaft to thereby permit the shaft to rotate in the first direction.

5. A controller according to claim 4 wherein the torques acting on the shaft and said controller act together to cause the shaft to assume either a position of advanced timing or a position of retarded timing absent addition external controls.

6. A controller for controlling the rotation and angular position of a shaft wherein the shaft is subject to alternating, opposing, oscillating torques, said controller comprising:

engaging means for engaging the shaft and inhibiting rotation of the shaft in a first direction while permitting rotation in a second direction wherein said engaging means comprises a locking surface selectively engageable with the shaft and said locking surface is movable between a disengaged position in which said locking surface does not inhibit rotation of the shaft in the first direction and an engaged position in which said locking surface engages the shaft; and release means for releasing said engaging means from engagement with the shaft to thereby permit the shaft to rotate in the first direction.

7. A controller according to claim 6 wherein said engaging means further comprises at least one bearing housed between said locking surface and the shaft, wherein said engaged position said bearing is wedged between said locking surface and the shaft.

8. A controller according to claim 6 wherein said release means comprises biasing means for moving said locking surface between said engaged position and said disengaged position.

9. A controller according to claim 6 further comprising stop means for limiting the rotation of the shaft.

10. A controller according to claim 9 wherein the torques acting on the shaft and said controller act together to cause the shaft to assume a position limited by said stop means.

11. A controller according to claim 6 wherein the shaft is rotatably disposed within a housing, said engaging means further comprises a piston type clutch disposed in a clutch receiving opening in the housing formed adjacent the shaft, said locking surface is an inclined locking surface disposed on said clutch which selectively engages a side surface of the shaft, said clutch further comprises an inner surface and an outer surface, said clutch is translatable within said clutch receiving opening between a disengaged position in which said clutch does not restrict rotation of the shaft and an engaged position in which said inclined locking surface of said clutch frictionally engages the shaft to provide a wedging among the housing, said clutch, and the shaft to thereby prevent rotation of the shaft in one direction, and said release means comprises biasing means for moving said clutch between said engaged position and said disengaged position.

12. A controller according to claim 11 wherein said biasing means comprises a compression spring disposed in said clutch receiving opening between an end wall of said clutch receiving opening and said inner surface of said clutch, said compression spring biasing said clutch toward said engaged position.

13. A controller according to claim 12 wherein said biasing means further comprises a fluid passageway disposed within the housing and communicating with said clutch receiving opening adjacent said outer surface of said clutch, and fluid within said fluid passageway exerts a pressure on said outer surface of said clutch to bias said clutch toward said disengaged position to thereby resist the biasing force of said compression spring.

14. A controller according to claim 13 further comprising sealing means for providing a fluid seal between the bottom surface of said clutch and said clutch receiving opening and for frictionally securing said clutch within said clutch receiving opening to thereby prevent translational oscillations of said clutch within said clutch receiving opening when the fluid pressure approximates the pressure caused by said compression spring.

15. A controller according to claim 14 wherein said clutch further comprises an annular groove adjacent said outer surface and said sealing means comprises an O-ring disposed within said annular groove.

16. A controller according to claim 11 wherein when said clutch is in said disengaged position the shaft is rotatable in both clockwise and counterclockwise directions, and when said clutch is in said engaged position the shaft is rotatable clockwise only.

17. A controller according to claim 11 wherein the housing further comprises stop means for limiting the rotation of the shaft and the shaft comprises a rotation limiting bar engageable with said stop means.

18. A controller according to claim 17 wherein the torques acting on the shaft and said controller act together to cause the shaft to assume a position limited by said stop means.

19. A controller according to claim 17 wherein said stop means comprises first and second pivot stops and said rotation limiting bar of the shaft is alternately engageable with one of said pivot stops.

20. A controller according to claim 19 wherein said pivot stops are oriented to limit the rotation of the shaft to 90 degrees.

21. A controller according to claim 19 wherein the counterclockwise torques dominate the clockwise torques acting on the shaft, so that in said disengaged position the dominating counterclockwise torques rotate the shaft until said rotation limiting bar engages said first pivot stop and in said engaged position the clockwise torques rotate the shaft clockwise until said rotation limiting bar engages said second pivot stop.

22. A controller according to claim 17 wherein said pivot stop means comprises two pivot stops and the position of the shaft is infinitely variable within the range of said two pivot stops.

23. A controller according to claim 6 wherein the shaft is rotatably disposed within a housing;

said locking surface comprises an inclined surface mounted on the housing;

said engaging means further comprises a clutch having a slot, said clutch being movable between a disengaged position and an engaged position, bearing means disposed between said inclined surface and the shaft and selectively wedged between said inclined surface and said shaft, and connecting means disposed in said slot in said clutch for connecting said clutch to said bearing means;

wherein said release means comprises biasing means for moving said clutch between said engaged position and said disengaged position; and wherein in said disengaged position rotation of the shaft is not restricted by said controller, and in said engaged position said bearing means frictionally engages and is wedged between said inclined surface and the shaft to prevent rotation of the shaft in one direction.

24. A controller according to claim 23 wherein said clutch is a piston type clutch translatably disposed in a clutch receiving opening in the housing formed adjacent the shaft, said clutch further having an inner surface and an outer surface.

25. A controller according to claim 24 wherein said biasing means comprises a compression spring disposed in said clutch receiving opening between an end wall of said clutch receiving opening and said inner surface of said clutch, said compression spring biasing said clutch toward said engaged position.

26. A controller according to claim 25 wherein said biasing means further comprises a fluid passageway disposed within the housing and communicating with said clutch receiving opening adjacent said outer surface of said clutch, and fluid within said fluid passageway exerts a pressure on said bottom surface of said clutch to bias said clutch toward said disengaged position to thereby resist the biasing force of said compression spring.

27. A controller according to claim 26 further comprising sealing means for providing a fluid seal between the outer surface of said clutch and said clutch receiving opening and for frictionally securing said clutch within said clutch receiving opening to thereby prevent translational oscillations of said clutch within said clutch receiving opening when the fluid pressure approximates the pressure caused by said compression spring.

28. A controller according to claim 27 wherein said clutch further comprises an annular groove adjacent said outer surface and said sealing means comprises an O-ring disposed within said annular groove.

29. A controller according to claim 24 wherein when said clutch is in said disengaged position the shaft is rotatable in both clockwise and counterclockwise directions, and when said clutch is in said engaged position the shaft is rotatable clockwise only.

30. A controller according to claim 24 wherein the housing further comprises stop means for limiting the rotation of the shaft and the shaft comprises a rotation limiting bar engageable with said stop means.

31. A controller according to claim 30 wherein the torques acting on the shaft and said controller act together to cause the shaft to assume a position limited by said stop means.

32. A controller according to claim 30 wherein said stop means comprises first and second pivot stops and said rotation limiting bar of the shaft is alternately engageable with one of said pivot stops.

33. A controller according to claim 32 wherein said pivot stops are oriented to limit the rotation of the shaft to 90 degrees.

34. A controller according to claim 32 wherein the counterclockwise torques dominate the clockwise torques acting on the shaft, so that in said disengaged position the dominating counterclockwise torques rotate the shaft until said rotation limiting bar engages said first pivot stop and in said engaged position the clockwise torques rotate the shaft clockwise until said rotation limiting bar engages said second pivot stop.

35. A controller according to claim 30 wherein said pivot stop means comprises two pivot stops and the position of the shaft is infinitely variable within the range of said two pivot stops.

36. A controller according to claim 23 wherein said clutch is a piston type clutch and is translatably disposed in a clutch receiving opening in the housing formed adjacent the shaft, and said bearing means comprises a plurality of bearings.

37. A controller according to claim 36 further comprising two annular cages for retaining said bearings around the shaft.

38. A controller according to claim 37 wherein said cages comprise cross members which hold said two cages together, and said connecting means comprises one said cross member.

39. A controller according to claim 38 comprising a plurality of inclined surfaces disposed end to end to form an annular ring of inclined surfaces, wherein at least one said bearing is disposed between the shaft and each said inclined surface.

40. A controller according to claim 39 further comprising bearing biasing means for biasing said bearings between adjacent said cross members.

41. A controller according to claim 40 wherein said bearing biasing means comprises a leaf spring.

42. A rotatable cam follower shaft system rotatable in either direction, said cam follower shaft system comprising:

a housing, said housing having a shaft receiving opening and a clutch receiving opening adjacent to said shaft receiving opening;

a cam follower shaft rotatably mounted within said shaft receiving opening of said housing;

an eccentric cam follower pivot disposed on said shaft, said cam follower pivot subjecting said shaft to alternating, opposing, oscillating torques;

a piston type clutch translatably disposed within said clutch receiving opening, said clutch having an inclined locking surface which selectively engages a side surface of said shaft, an inner surface, and an outer surface, said clutch being translatable within said clutch receiving opening between a disengaged position in which said clutch does not restrict rotation of said shaft and an engaged position in which said inclined locking surface of said clutch frictionally engages said shaft to provide a wedging among said housing, said clutch, and said shaft to thereby prevent rotation of said shaft in a counterclockwise direction; and biasing means for moving said clutch between said engaged position and said disengaged position;

wherein the counterclockwise torques dominate the clockwise torques acting on the shaft, so that in said disengaged position the dominating counterclockwise torques rotate said shaft counterclockwise and in said engaged position the clockwise torques rotate said shaft clockwise and wherein the torques acting on the shaft and said clutch act together to cause said shaft to assume either a position of advanced timing or a position of retarded timing absent external controls.

43. A cam follower shaft system according to claim 42 wherein said biasing means comprises a compression spring disposed in said clutch receiving opening between an end wall of said clutch receiving opening and said inner surface of said clutch, said compression spring biasing said clutch toward said engaged position to prevent said shaft from rotating in a counterclockwise direction; and a fluid passageway disposed within said housing and communicating with said clutch receiving opening adjacent said outer surface of said clutch so that fluid within said fluid passageway exerts a pressure on said outer surface of said clutch to bias said clutch toward said disengaged position and to thereby resist the biasing force of said compression spring, so that when the fluid pressure exceeds the pressure exerted by said compression spring, said clutch disengages from said cam follower shaft to permit said cam follower shaft to rotate in either direction.

44. A cam follower shaft system according to claim 43 wherein said clutch further comprises an O-ring disposed within an annular groove adjacent said outer surface of said clutch, said O-ring providing a fluid seal between the outer surface of said clutch and said clutch receiving opening and frictionally securing said clutch within said clutch receiving opening to prevent translational oscillations of said clutch within said clutch receiving opening when the fluid pressure approximates the pressure provided by said compression spring.

45. A rotatable cam follower shaft system rotatable in either direction, said cam follower shaft system comprising:

a housing, said housing having a shaft receiving opening and a clutch receiving opening adjacent to said shaft receiving opening;

a cam follower shaft rotatably mounted within said shaft receiving opening of said housing;

an eccentric cam follower pivot disposed on said shaft, said cam follower pivot subjecting said shaft to alternating, opposing, oscillating torques;

a piston type clutch disposed in a clutch receiving opening in the housing formed adjacent the shaft, said clutch having a slot, an inner surface, and an outer surface, and being translatable between a disengaged position and an engaged position;

a plurality of inclined surfaces disposed end to end to form an annular ring of inclined surfaces, said annular ring being mounted on the housing;

a plurality of bearing disposed between said inclined surface and the shaft and selectively wedged between said inclined surface and said shaft, wherein at least one said bearing is disposed between the shaft and each said inclined surface;

two annular cages for retaining said bearings around the shaft, wherein said cages comprise cross members which hold said two cages together, and one said cross member is disposed in said slot in said clutch to thereby connect said clutch to said bearings;

leaf springs which bias said bearings between adjacent said cross members; and biasing means for moving said clutch between said engaged position and said disengaged position;

wherein in said disengaged position rotation of the shaft is not restricted by said controller, and in said engaged position said bearings frictionally engage and are wedged between said inclined surface and the shaft to prevent rotation of the shaft in one direction; and wherein the counterclockwise torques dominate the clockwise torques acting on the shaft, so that in said disengaged position the dominating counterclockwise torques rotate said shaft counterclockwise and in said engaged position the clockwise torques rotate said shaft clockwise and wherein the torques acting on said shaft and said clutch act together to cause said shaft to assume either a position of advanced timing or a position of retarded timing absent external controls.

46. A cam follower shaft system according to claim 45 wherein said biasing means comprises a compression spring disposed in said clutch receiving opening between an end wall of said clutch receiving opening and said inner surface of said clutch, said compression spring biasing said clutch toward said engaged position to prevent said shaft from rotating in a counterclockwise direction; and a fluid passageway disposed within said housing and communicating with said clutch receiving opening adjacent said outer surface of said clutch so that fluid within said fluid passageway exerts a pressure on said bottom surface of said clutch to bias said clutch toward said disengaged position and to thereby resist the biasing force of said compression spring, so that when the fluid pressure exceeds the pressure exerted by said compression spring, said clutch disengages form said cam follower shaft to permit said cam follower shaft to rotate in either direction.

47. A cam follower shaft system according to claim 46 wherein said clutch further comprises an O-ring disposed within an annular groove adjacent said outer surface of said clutch, said O-ring providing a fluid seal between said outer surface of said clutch and said clutch receiving opening and frictionally securing said clutch within said clutch receiving opening to prevent translational oscillations of said clutch within said clutch receiving opening when the fluid pressure approximates the pressure provided by said compression spring.

* * * * *